US009366995B2

(12) United States Patent
Hatano et al.

(10) Patent No.: US 9,366,995 B2
(45) Date of Patent: Jun. 14, 2016

(54) DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Masaru Hatano, Osaka (JP); Akifumi Yamaguchi, Osaka (JP); Yu Sasaki, Osaka (JP); Ryo Taniguchi, Osaka (JP); Eiji Gyotoku, Osaka (JP); Koji Kuramashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/739,084

(22) Filed: Jun. 15, 2015

(65) Prior Publication Data

US 2015/0378277 A1 Dec. 31, 2015

(30) Foreign Application Priority Data

Jun. 25, 2014 (JP) ..... 2014-130177

(51) Int. Cl.
*G03G 15/08* (2006.01)
*G03G 15/09* (2006.01)

(52) U.S. Cl.
CPC ..... *G03G 15/0893* (2013.01); *G03G 15/0818* (2013.01); *G03G 15/0921* (2013.01); *G03G 2215/0863* (2013.01)

(58) Field of Classification Search
CPC ..... G03G 15/0806; G03G 15/0818; G03G 15/0822; G03G 15/1887; G03G 15/0891; G03G 15/0893; G03G 15/0921; G03G 2215/0863; G03G 15/0887
USPC ..... 399/286, 279, 254, 256
See application file for complete search history.

(56) References Cited

U.S. PATENT DOCUMENTS

2007/0253720 A1* 11/2007 Kasai ..... G03G 15/0893 399/27
2008/0025763 A1* 1/2008 Suenami ..... G03G 15/0893 399/256
2009/0154962 A1* 6/2009 Kotera ..... G03G 15/0928 399/276
2009/0311012 A1 12/2009 Mabuchi et al.
(Continued)

FOREIGN PATENT DOCUMENTS

JP 2001-134116 5/2001
JP 2009-300677 12/2009

*Primary Examiner* — Sophia S Chen
(74) *Attorney, Agent, or Firm* — Gerald E. Hespos; Michael J. Porco; Matthew T. Hespos

(57) ABSTRACT

A developing device includes a housing, a developer carrier, a conveying member and a surface layer. The conveying member conveys the developer in the first conveying direction and supplies the developer to the developer carrier. The surface layer is arranged on the circumferential surface of the developer carrier and formed on a surface of a predetermined cylindrical base member. The surface layer is formed by an immersion method of immersing the base member in an immersion tank so that an axial direction of the base member extends along a vertical direction. A lower end side of the base member at the time of the immersion is arranged in a downstream side of the housing in the first conveying direction and an upper end side of the base member at the time of the immersion is arranged in an upstream side of the housing in the first conveying direction.

16 Claims, 7 Drawing Sheets

(56) References Cited

U.S. PATENT DOCUMENTS

2010/0260507 A1* 10/2010 Kakubari ..... G03G 15/0893 399/30
2011/0158700 A1* 6/2011 Iwata ..... G03G 15/0893 399/254
2012/0201573 A1* 8/2012 Watanabe ..... G03G 15/0893 399/256
2013/0287454 A1* 10/2013 Anan ..... G03G 15/0818 399/286
2015/0293470 A1* 10/2015 Shimizu ..... G03G 15/0808 399/265

* cited by examiner

DEVELOPING DEVICE AND IMAGE FORMING APPARATUS PROVIDED WITH SAME

INCORPORATION BY REFERENCE

This application is based on Japanese Patent Application No. 2014-130177 filed with the Japan Patent Office on Jun. 25, 2014, the contents of which are hereby incorporated by reference.

BACKGROUND

The present disclosure relates to a developing device and an image forming apparatus provided with the same.

In an electrophotographic image forming apparatus such as a copier, a printer or a facsimile machine, a developing device supplies toner to an electrostatic latent image formed on a photoconductive drum to develop the electrostatic latent image, whereby a toner image is formed on the photoconductive drum. The developing device includes a developing roller rotatably supported in a housing. The developing roller is arranged with a predetermined gap defined between the developing roller and the photoconductive drum and carries a developer containing at least toner on a circumferential surface. Further, there is known a technology for providing a resin layer on a surface of a developing roller. There is known an immersion method (dip method, dipping method) of manufacturing a developing roller by immersing a raw tube of the developing roller into a resin liquid in which a resin material is dissolved in advance. There is also known a technology for forming a resistance layer on a surface of a photoconductive drum by the immersion method. In such a developing device, an agitating member is arranged to face the developing roller. The agitating member supplies the developer to the developing roller while conveying the developer in a predetermined conveying direction.

SUMMARY

A developing device according to one aspect of the present disclosure includes a housing, a developer carrier, a developer storage, a conveying member and a surface layer. The developer carrier is formed into a cylindrical shape and supported in the housing rotatably about an axis and carries a developer on a circumferential surface. The developer storage is arranged in the housing to face the developer carrier. The developer storage includes a first conveying portion in which the developer is conveyed in a first conveying direction from one end side toward the other end side in an axial direction of the developer carrier and a second conveying portion which communicates with the first conveying portion on opposite end parts in the axial direction and in which the developer is conveyed in a second conveying direction opposite to the first conveying direction. The conveying member is rotatably arranged in the first conveying portion and conveys the developer in the first conveying direction and supplies the developer to the developer carrier. The surface layer is arranged on or arranged to face the circumferential surface of the developer carrier and formed on a surface of a predetermined cylindrical base member. The surface layer is formed by an immersion method of immersing the base member in a predetermined immersion tank so that an axial direction of the base member extends along a vertical direction. A lower end side of the base member at the time of the immersion is arranged in a downstream side of the housing in the first conveying direction and an upper end side of the base member at the time of the immersion is arranged in an upstream side of the housing in the first conveying direction.

An image forming apparatus according to another aspect of the present disclosure includes the above developing device and an image carrier. An electrostatic latent image is formed on a surface of the image carrier and the developer is supplied to the image carrier from the developing device.

DETAILED DESCRIPTION

Hereinafter, one embodiment of the present disclosure is described with reference to the drawings. Note that the present disclosure can be applied to an electrophotographic image forming apparatus such as a copier, a printer, a facsimile machine or a complex machine provided with these functions.

Figure 1:
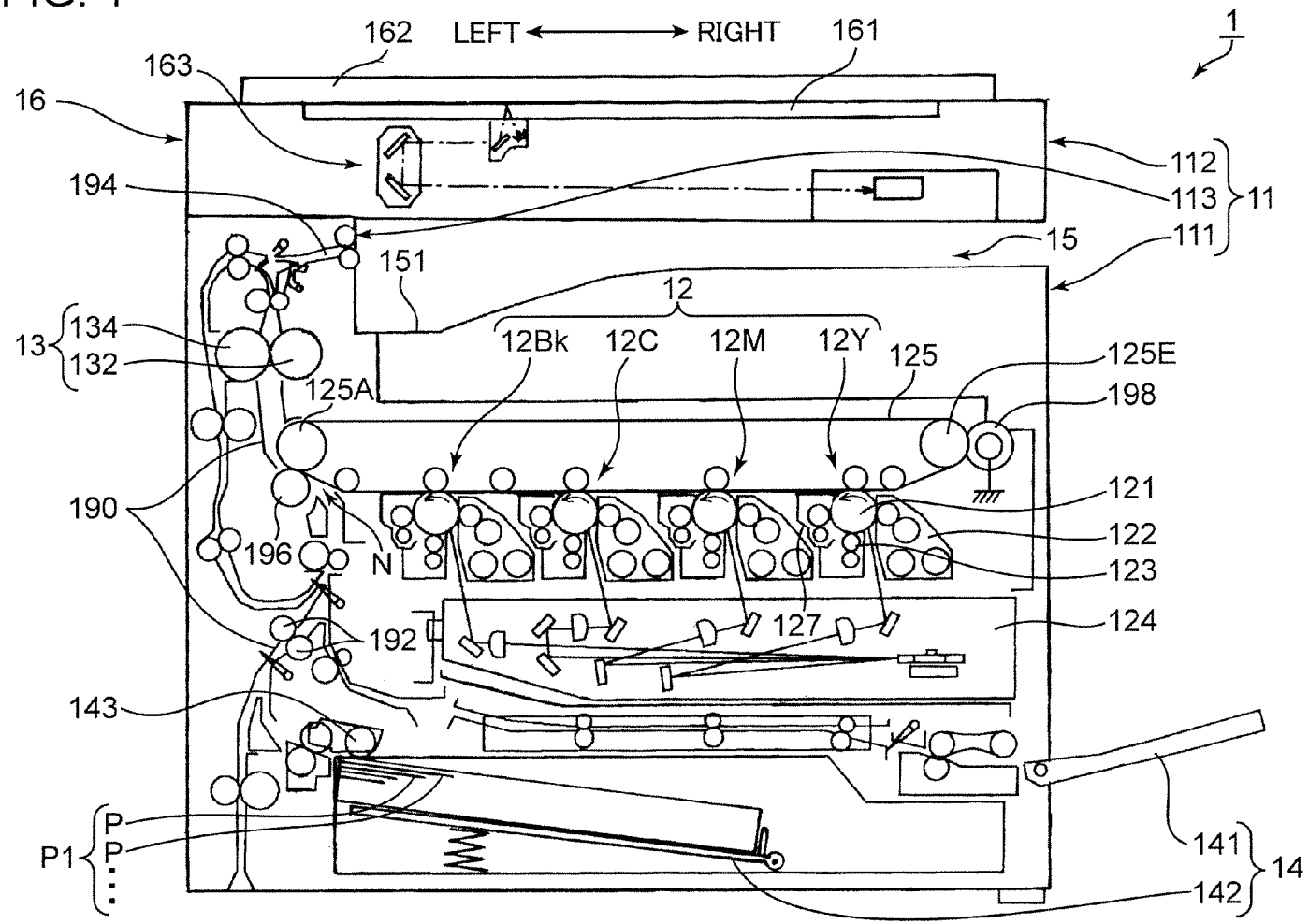
FIG. 1 is a sectional view showing the internal structure of an image forming apparatus according to one embodiment of the present disclosure.

FIG. 1 is a sectional front view showing the structure of an image forming apparatus 1 according to the one embodiment of the present disclosure. The image forming apparatus 1 is so configured that an image forming station 12, a fixing device 13, a sheet feeding unit 14, a sheet discharging unit 15, a document reading unit 16 and the like are provided in an apparatus main body 11.

The apparatus main body 11 includes a lower main body 111, an upper main body 112 arranged to face this lower main body 111 from above and a coupling portion 113 interposed between these upper and lower main bodies 112, 111. The coupling portion 113 is a structure for coupling the lower and upper main bodies 111, 112 to each other in a state where the sheet discharging unit 15 is formed between the both, stands from left and rear parts of the lower main body 111 and is L-shaped in a plan view. The upper main body 112 is supported on an upper end part of the coupling portion 113.

The image forming station 12, the fixing device 13 and the sheet feeding unit 14 are housed in the lower main body 111 and the document reading unit 16 is mounted in the upper main body 112.

The image forming station 12 performs an image forming operation of forming a toner image on a sheet P fed from the sheet feeding unit 14. The image forming station 12 includes a yellow unit 12Y, a magenta unit 12M, a cyan unit 12C and a black unit 12Bk respectively using toner of yellow, magenta, cyan and black colors and successively arranged from an upstream side toward a downstream side in a horizontal direction, an intermediate transfer belt 125 stretched on a plurality of rollers such as a drive roller 125A in such a manner as to be able to endlessly travel in a sub scanning direction in image formation, a secondary transfer roller 196 held in contact with the outer peripheral surface of the intermediate transfer belt 125, and a belt cleaning device 198.

The unit of each color of the image forming station 12 integrally includes a photoconductive drum 121 (image carrier), a developing device 122 for supplying the toner (developer) to the photoconductive drum 121, a toner cartridge (not shown) containing the toner, a charging device 123 and a drum cleaning device 127. Further, an exposure device 124 for exposing each photoconductive drum 121 to light is horizontally arranged below the adjacent developing devices 122.

The photoconductive drum 121 is formed into a cylindrical shape and rotated about an axis. The photoconductive drum 121 has an electrostatic latent image formed on the circumferential surface thereof and carries a toner image obtained by developing the electrostatic latent image with the toner. In this embodiment, the photoconductive drum 121 is a known organic photoconductor (OPC) and a charge generation layer, a charge transport layer and the like are formed on a surface by an immersion method similarly to a developing roller 83 to be described later.

The developing device 122 supplies the toner to an electrostatic latent image on the circumferential surface of the photoconductive drum 121 rotating in a direction of an arrow to form a layer of the toner, and forms a toner image corresponding to image data on the circumferential surface of the photoconductive drum 121. The toner is appropriately supplied to each developing device 122 from the toner cartridge.

Each charging device 123 is provided at a position right below the corresponding photoconductive drum 121. The charging device 123 uniformly charges the circumferential surface of each photoconductive drum 121.

The exposure device 124 is provided at a position below the respective charging devices 123. The exposure device 124 irradiates the charged circumferential surface of the photoconductive drum 121 with laser light corresponding to each color based on image data input from a computer or the like or image data obtained by the document reading unit 16, thereby forming an electrostatic latent image on the circumferential surface of each photoconductive drum 121. Note that the exposure device 124 irradiates the laser light according to an exposure light amount set in advance in order to form a predetermined latent image potential on the photoconductive drum 121. The drum cleaning device 127 is provided to the left of each photoconductive drum 121 and cleans the circumferential surface of the photoconductive drum 121 by removing the residual toner.

The intermediate transfer belt 125 is an endless, electrically conductive and soft belt having a laminated structure composed of a base layer, an elastic layer and a coating layer. The intermediate transfer belt 125 is mounted on a plurality of tension rollers arranged substantially in the horizontal direction above the image forming station 12. The tension rollers include the drive roller 125A arranged near the fixing device 13 to rotationally drive the intermediate transfer belt 125 and a driven roller 125E arranged at a predetermined distance from the drive roller 125A in the horizontal direction and configured to rotate, following the rotation of the intermediate transfer belt 125. The intermediate transfer belt 125 is driven to rotate in a clockwise direction in FIG. 1 by giving a rotational drive force to the drive roller 125A.

A secondary transfer bias applying unit (not shown) is electrically connected to the secondary transfer roller 196. A toner image formed on the intermediate transfer belt 125 is transferred to a sheet P conveyed from a pair of conveyor rollers 192 located below by a transfer bias applied at a nip N between the secondary transfer roller 196 and the drive roller 125A. The belt cleaning device 198 is arranged to face the driven roller 125E via the intermediate transfer belt 125.

The fixing device 13 includes a heating roller 132 internally provided with an electrical heating element such as a halogen lamp as a heat source, and a pressure roller 134 arranged to face the heating roller 132. The fixing device 13 applies a fixing process to a toner image on a sheet P transferred in the image forming station 12 by giving heat from the heating roller 132 while the sheet P is passing through a fixing nip portion between the heating roller 132 and the pressure roller 134. The color-printed sheet P completed with the fixing process is discharged toward a sheet discharge tray 151 provided on the top of the apparatus main body 11 through a sheet discharge conveyance path 194 extending from an upper part of the fixing device 13.

The sheet feeding unit 14 includes a manual feed tray 141 openably and closably provided on a right side wall of the apparatus main body 11 in FIG. 1 and a sheet cassette 142 detachably mounted at a position below the exposure device 124 in the apparatus main body 11. The sheet cassette 142 stores a sheet stack P1 formed by stacking a plurality of sheets P. A pickup roller 143 is provided above the sheet cassette 142 and feeds the uppermost sheet P of the sheet stack P1 stored in the sheet cassette 142 toward a sheet conveyance path 190. The manual feed tray 141 is a tray provided at a lower position on the right surface of the lower main body 111 for manually feeding sheets P one by one toward the image forming station 12.

The vertically extending sheet conveyance path 190 is formed to the left of the image forming station 12. The pair of conveyor rollers 192 are provided at a suitable position in the sheet conveyance path 190 and conveys a sheet P fed from the sheet feeding unit 14 toward a secondary transfer nip portion including the secondary transfer roller 196.

The sheet discharging unit 15 is formed between the lower and upper main bodies 111, 112. The sheet discharging unit 15 includes the sheet discharge tray 151 formed on the upper surface of the lower main body 111. The sheet discharge tray 151 is a tray onto which a sheet P having a toner image formed in the image forming station 12 is discharged after a fixing process is applied thereto in the fixing device 13.

The document reading unit 16 includes a contact glass 161 which is mounted in an upper surface opening of the upper main body 112 and on which a document is to be placed, a document pressing cover 162 which is free to open and close and presses a document and a scanning mechanism 163 which scans and reads an image of a document placed on the contact glass 161. The scanning mechanism 163 optically reads an image of a document using an image sensor such as a CCD (Charge Coupled Device) or a CMOS (Complementary Metal Oxide Semiconductor) and generates image data. Further, the apparatus main body 11 includes an image processing unit (not shown) for generating an image from this image data.

<Configuration of the Developing Device>

Figure 2:
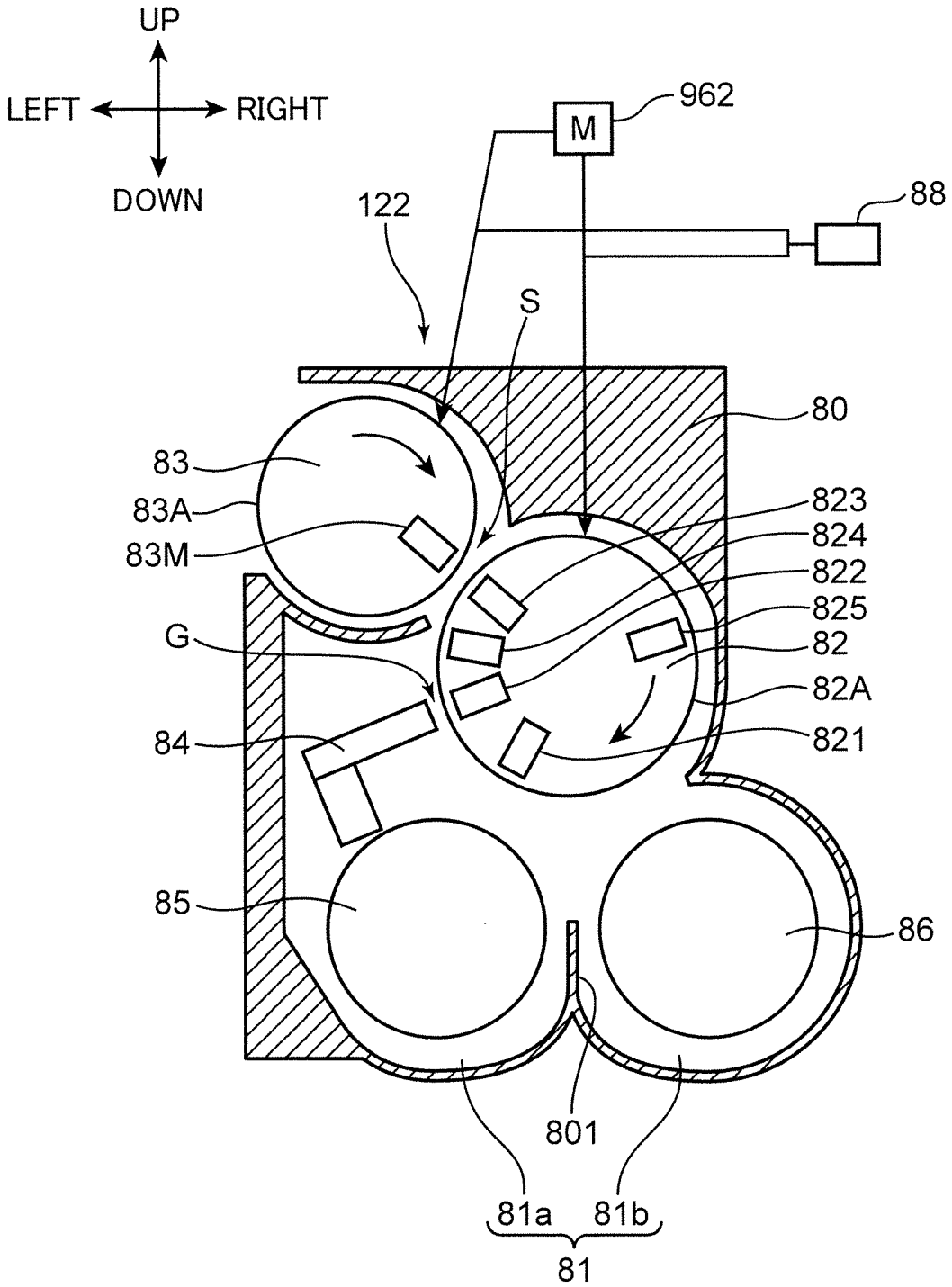
FIG. 2 is a sectional view of a developing device according to the one embodiment of the present disclosure.
Figure 3A:
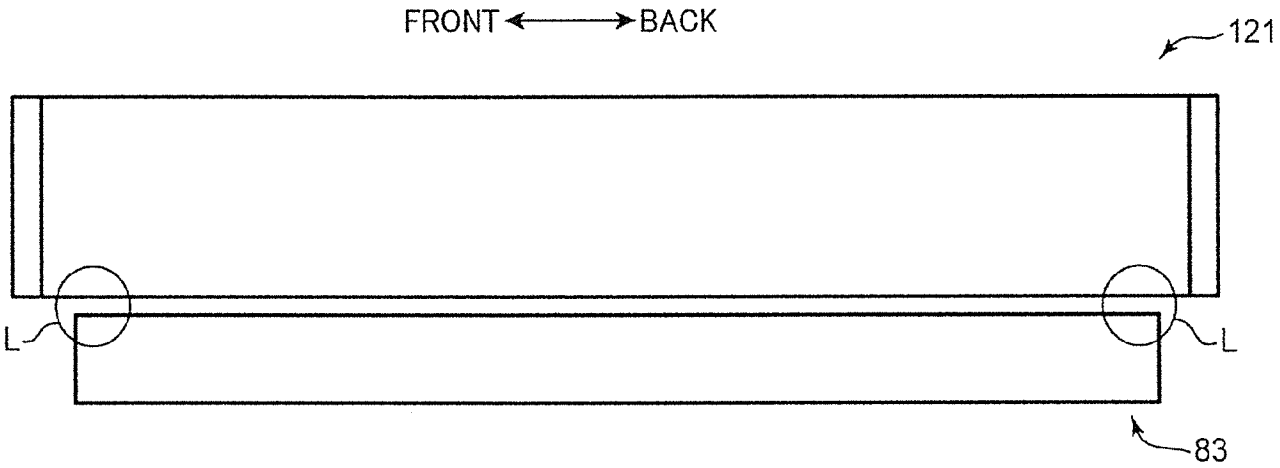
FIG. 3A is a diagram showing a relationship of axial lengths of an image carrier and a toner carrier according to the one embodiment of the present disclosure and FIG. 3B is a schematic sectional view showing a film thickness on an end part of the toner carrier.
Figure 3B:
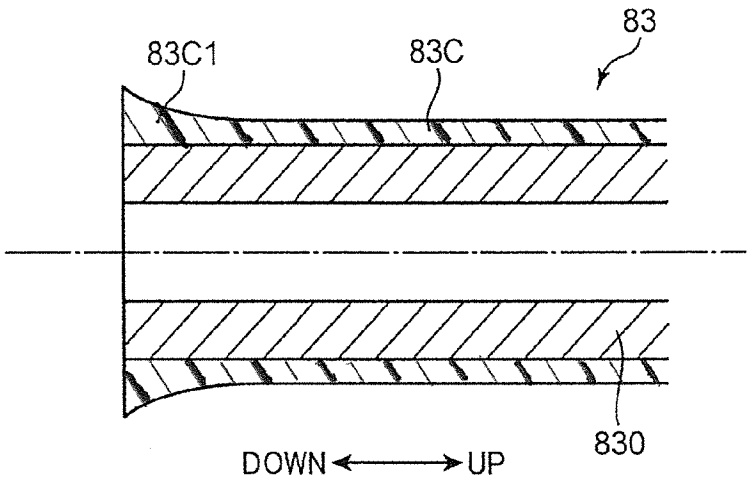
Figure 4A:
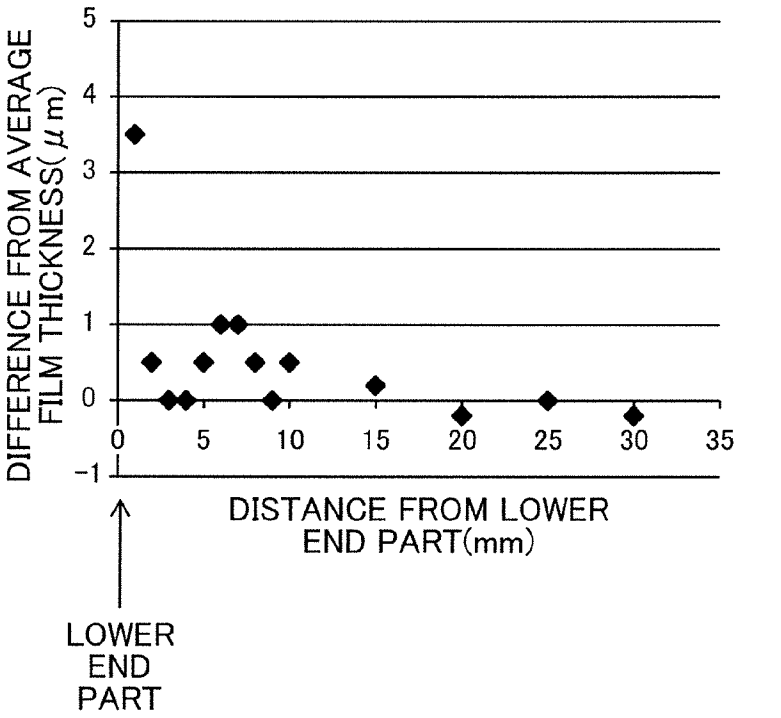
FIGS. 4A and 4B are graphs showing an axial film thickness distribution of the toner carrier according to the one embodiment of the present disclosure.
Figure 4B:
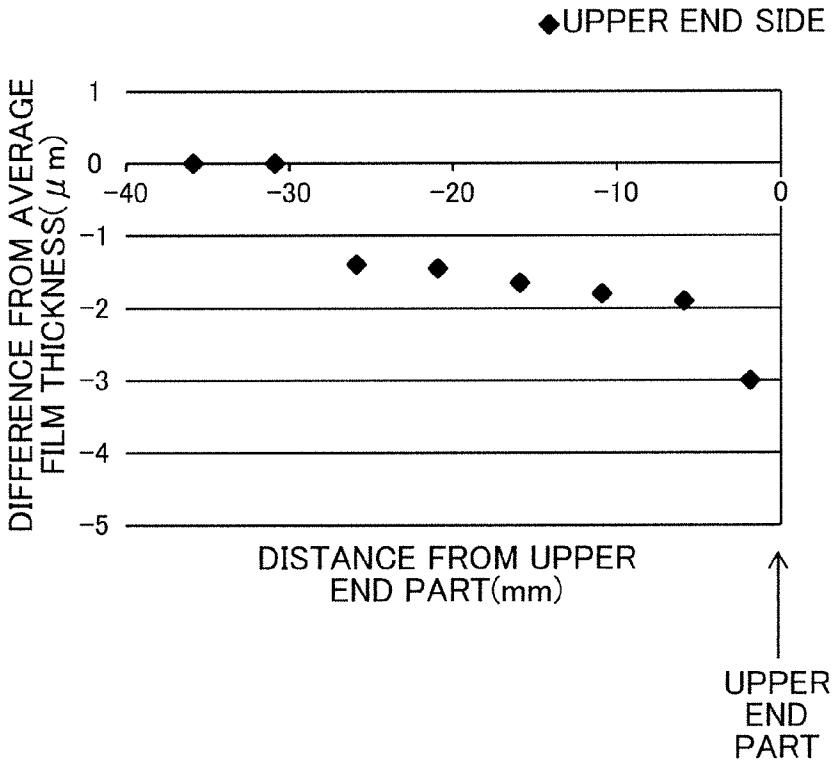
Figure 5:
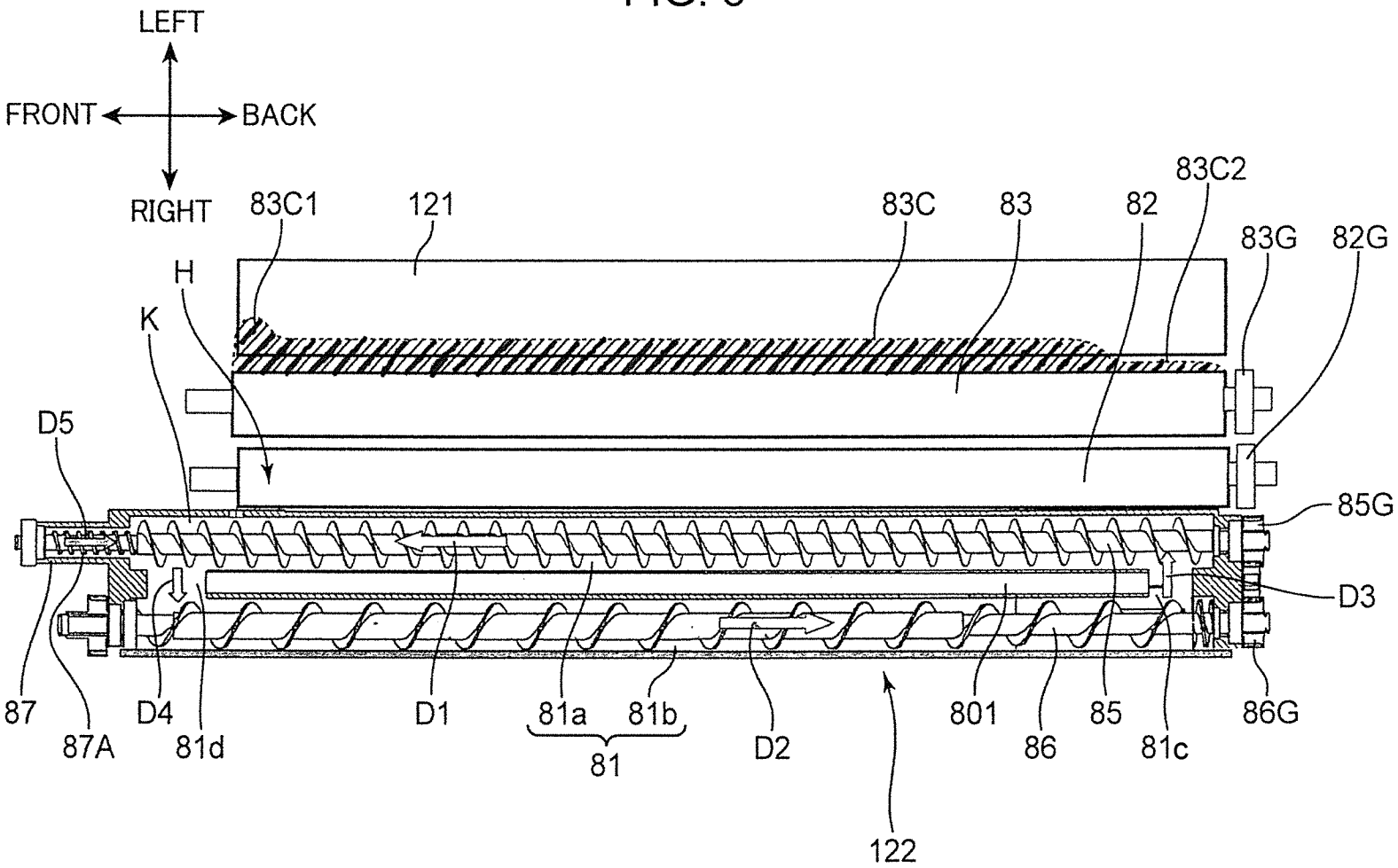
FIG. 5 is a schematic plan view of the developing device according to the one embodiment of the present disclosure.

Next, the developing device 122 is described in detail. FIG. 2 is a vertical and lateral sectional view schematically showing the internal structure of the developing device 122. FIG. 3A is a diagram showing a relationship of axial lengths of the photoconductive drum 121 and the developing roller 83 according to this embodiment and FIG. 3B is a schematic sectional view showing a film thickness on an end part of the developing roller 83. FIGS. 4A and 4B are graphs showing axial film thickness distributions of the developing roller 83. FIG. 5 is a schematic plan view of the developing device 122 according to this embodiment. Note that a magnetic roller 82 and the developing roller 83 are shown to be displaced to left in FIG. 5 for the sake of description. A touch-down development method using the developing roller 83 and the magnetic roller 82 is adopted for the developing device 122 in this embodiment. The developing device 122 includes a development housing 80 (housing) defining an internal space of the developing device 122. This development housing 80 includes a developer storage 81 for storing a developer containing nonmagnetic toner to be charged to a predetermined polarity and magnetic carrier. Further, the magnetic roller 82 (developer carrier) arranged above the developer storage 81, the developing roller 83 (toner carrier) arranged to face the magnetic roller 82 at a position obliquely above the magnetic roller 82 and a developer regulation blade 84 (layer thickness regulating member) arranged to face the magnetic roller 82 are arranged in the development housing 80. Further, the developing device 122 includes a driving unit 962 and a development bias applying unit 88 (FIG. 2).

With reference to FIGS. 2 and 5, the developer storage 81 is arranged to face the magnetic roller 82 in the development housing 80. The developer storage 81 includes two adjacent first developer storage chamber 81*a* (first conveying portion) and second developer storage chamber 81*b* (second conveying portion) extending in a longitudinal direction of the developing device 122. The first developer storage chamber 81*a* is arranged to face the magnetic roller 82. The first and second developer storage chambers 81*a*, 81*b* are partitioned from each other by a partition plate 801 integrally formed to the development housing 80 and extending in the longitudinal direction, but communicate with each other through a first and a second communication portions 81*c*, 81*d* (communication portion) at opposite end parts in the longitudinal direction (axial direction). In the first developer storage chamber 81*a*, the developer is conveyed in a first conveying direction from a rear side toward a front side (from one end side to the other end side in the axial direction of the magnetic roller 82) (arrow D1 of FIG. 5). In the second developer storage chamber 81*b*, the developer is conveyed in a second conveying direction (arrow D2 of FIG. 5) opposite to the first conveying direction. Note that the second communication portion 81*d* allows communication between a downstream side of the first developer storage chamber 81*a* in the first conveying direction and an upstream side of the second developer storage chamber 81*b* in the second conveying direction.

In this embodiment, the second communication portion 81*d* functions as a developer retaining portion. The developer retaining portion is arranged in the downstream side of the first developer storage chamber 81*a* in the first conveying direction and causes the developer to be partially retained. In a cross-section intersecting with a direction in which the developer is conveyed in the developer storage 81, a cross-sectional area of the second communication portion 81*d* is set smaller than that of the first developer storage chamber 81*a*. As a result, a retaining portion K (FIG. 5) for the developer is formed in the downstream side of the first developer storage chamber 81*a* in the first conveying direction.

A first screw feeder 85 and a second screw feeder 86 for agitating and conveying the developer by rotating about their axes are respectively rotatably housed in the first and second developer storage chambers 81*a*, 81*b*. The first and second screw feeders 85, 86 are each provided with a shaft portion and a spiral blade arranged around the shaft portion. Rotating directions of the first and second screw feeders 85, 86 are set to be opposite to each other. This causes the developer to be conveyed in a circulating manner between the first and second developer storage chambers 81*a*, 81*b* while being agitated as indicated by arrows D1, D4, D2 and D3 of FIG. 5. By this agitation, the toner and the carrier are mixed and the toner is, for example, positively charged. A first screw gear 85G and a second screw gear 86G are respectively fixed to rear end parts of the first and second screw feeders 85, 86.

The magnetic roller 82 is formed into a cylindrical shape and rotatably supported in the development housing 80 to face the developing roller 83 along the longitudinal direction of the developing device 122. The magnetic roller 82 is driven to rotate in a clockwise direction in FIG. 2. A fixed so-called magnet roll (fixed magnet, not shown) is arranged in the magnetic roller 82. The magnet roll includes a plurality of poles, in this embodiment, a draw-up pole 821, a regulating pole 822, a main pole 823, a carrying pole 824 and a peeling pole 825. The draw-up pole 821 faces the developer storage 81, the regulating pole 822 faces the developer regulation blade 84 and the main pole 823 faces the developing roller 83.

The magnetic roller 82 magnetically draws up (receives) the developer onto a circumferential surface 82A thereof from the developer storage 81 by a magnetic force of the draw-up pole 821. The magnetic roller 82 magnetically carries the drawn-up developer as a developer layer (magnetic brush layer) on the circumferential surface 82A. Then, the magnetic roller 82 supplies the toner to the developing roller 83. With the rotation of the magnetic roller 82, the developer is conveyed toward the developer regulation blade 84.

The developer regulation blade 84 is arranged to face the magnetic roller 82 at a distance from the magnetic roller 82 at a side upstream of the developing roller 83 when viewed in a rotating direction of the magnetic roller 82. The developer regulation blade 84 regulates a layer thickness of the developer supplied from the first screw feeder 85 and magnetically adhering to the circumferential surface 82A of the magnetic roller 82. A regulation gap G of a predetermined dimension is formed between the developer regulation blade 84 and the circumferential surface 82A of the magnetic roller 82. This causes a developer layer having a uniform predetermined thickness to be formed on the circumferential surface 82A.

The developing roller 83 is arranged to extend along the longitudinal direction of the developing device 122 and in parallel to the magnetic roller 82 and rotationally driven in a clockwise direction in FIG. 2. The developing roller 83 is arranged to face the photoconductive drum 121 at a predetermined distance from the photoconductive drum 121. The developing roller 83 is formed into a cylindrical shape and supported in the development housing 80 rotatably about an axis. The developing roller 83 has a circumferential surface 83A for carrying a toner layer by receiving the toner from the developer layer while rotating in contact with the developer layer held on the circumferential surface 82A of the magnetic roller 82. At the time of development in which a developing operation is performed, the developing roller 83 supplies the toner of the toner layer to the circumferential surface of the photoconductive drum 121. In this embodiment, the developing roller 83 is a roller with a cylindrical sleeve 830 (base member) and a coating layer 83C (nylon coating) (surface layer) made of resin and formed on a surface of the sleeve 830 (FIG. 3B). In other words, the sleeve 830 is a part of the developing roller 83 and the coating layer 83C is formed on the circumferential surface of the developing roller 83 and arranged to face the circumferential surface of the magnetic roller 82. Further, an opposing magnet 83M is arranged in the developing roller 83. The opposing magnet 83M is arranged to face the main pole 823 of the magnetic roller 82.

The developing roller 83, the magnetic roller 82 and the first and second screw feeders 85, 86 are rotationally driven by the driving unit 962. As shown in FIG. 5, a roller gear 83G is fixed to a rear end part of the developing roller 83. Further, an input gear 82G is fixed to a rear end part of the magnetic roller 82. The driving unit 962 is a motor for generating a rotational drive force. The driving unit 962 is coupled to the input gear 82G. A rotational drive force input to the input gear 82G is transmitted to the roller gear 83G and the second screw gear 86G. The roller gear 83G transmits the rotational drive force to the developing roller 83. The second screw gear 86G transmits the rotational drive force to the second screw feeder 86. The second screw gear 86G is further coupled to the first screw gear 85G. The first screw gear 85G transmits the rotational drive force to the first screw feeder 85. As a result, the developing roller 83, the magnetic roller 82, the first and second screw feeders 85, 86 are synchronously rotated by the rotational drive force generated by the driving unit 962.

A clearance S of a predetermined dimension (FIG. 2) is formed between the circumferential surface 83A of the developing roller 83 and the circumferential surface 82A of the magnetic roller 82. The clearance S is, for example, set at 0.3 mm. The developing roller 83 is arranged to face the photoconductive drum 121 through an opening formed on the development housing 80 and a clearance of a predetermined dimension is also formed between the circumferential surface 83A and the circumferential surface of the photoconductive drum 121. In this embodiment, this clearance is set at 0.12 mm.

The development bias applying unit 88 applies development biases, in which a direct-current voltage and an alternating-current voltage are superimposed, to the magnetic roller 82 and the developing roller 83. A high alternating-current voltage is applied between the photoconductive drum 121 and the developing roller 83 and between the developing roller 83 and the magnetic roller 82.

With reference to FIG. 5, the developing device 122 further includes a toner replenishing portion 87 (developer replenishing portion). The toner replenishing portion 87 communicates with the downstream side of the first developer storage chamber 81*a* in the first conveying direction. The toner replenishing portion 87 includes a hollow cylindrical wall portion having a space portion inside and a replenishment screw 87A configured to rotate in the space portion. The replenishment screw 87A is a screw blade coaxially fixed onto the first screw feeder 85. The replenishment screw 87A is arranged in a direction opposite to the screw blade of the first screw feeder 85. When replenishment toner is supplied into an unillustrated toner replenishment port open on the toner replenishing portion 87 from the aforementioned toner cartridge, the replenishment toner is caused to flow in the direction D5 into the first developer storage chamber 81*a* by the replenishment screw 87A. At this time, the replenishment toner flows into the retaining portion K retained by the second communication portion 81*d*, whereby the developer circulating in the developer storage 81 and the replenishment toner are stably and efficiently agitated.

With reference to FIG. 3A, the axial length of the photoconductive drum 121 is set longer than that of the developing roller 83 in this embodiment. Thus, opposite axial end parts of the developing roller 83 are facing the photoconductive drum 121 in regions L inwardly of opposite axial end parts of the photoconductive drum 121. Note that unillustrated tracking rollers are fixed to the opposite axial end parts of the developing roller 83. The tracking rollers regulate the gap between the developing roller 83 and the photoconductive drum 121 by being held in contact with the opposite end parts of the photoconductive drum 121. Further, the development housing 80 is biased toward the photoconductive drum 121 by an unillustrated biasing spring. As a result, the gap between the developing roller 83 and the photoconductive drum 121 is more stably maintained. Note that the axial length of the photoconductive drum 121 may be substantially equal to that of the developing roller 83 in this embodiment.

With reference to FIG. 3B, the sleeve 830 of the developing roller 83 is made of aluminum. The coating layer 83C of the developing roller 83 is formed by the following immersion method. First, an alumite processing is applied to the outer circumferential surface of the sleeve 830 to form an alumite layer (oxide layer) having a thickness of 10 μm. By forming the oxide layer on the sleeve 830 made of aluminum, an adhesive force of the coating layer 83C to the base member is increased. As a result, the peeling of the coating layer 83C is suppressed. Thereafter, the surface of the sleeve 830, i.e. the surface of the alumite layer is heated at 120° C. for 10 mins. This heating process is performed to intentionally crack the sleeve 830 in advance to suppress the formation of cracks in a drying step of the coating layer 83C. The time of the heating process is determined in advance, e.g. determined to be longer than a time required for the drying step. The heating process is constantly performed at a fixed temperature only for a fixed time. This causes a substantially fixed amount of cracks to be formed on all the sleeves 830 to which the heating process is applied. A process of forming the coating layer 83C on the alumite layer is performed after the heating process. Specifically, a mixture liquid is prepared by mixing alcohol-soluble nylon resin as binder resin, titanium oxide as a conductive agent and 800 (weight parts) of methanol as a dispersion medium together with zirconia beads having a diameter of 1.0 mm in a ball mill for 48 hrs. The alumite-processed sleeve 830 is pulled up after being immersed in the mixture liquid for a predetermined time, and dried for 10 mins. under a high-temperature environment of 130° C. Note that the sleeve 830 is so immersed into the mixture liquid that an axial direction of the cylindrical shape extends along a vertical direction, and then pulled up. As a result, the sleeve 830 coated with the coating layer 83C having a thickness of 2 to 11 μm is manufactured. As just described, cracks are formed on the alumite layer by the heating process in advance before the coating layer 83C is coated. This prevents the conductive agent contained in the coating layer 83C from being unevenly distributed due to the influence of a convection generated in the coating layer 83C during the drying of the coating layer 83C. As a result, it is possible to form the coating layer 83C in which the conductive agent is evenly distributed.

On the other hand, in the case of forming the coating layer 83C by the immersion method as described above, the mixture liquid adhering to the surface of the sleeve 830 tends to drip downward due to gravity when the sleeve 830 is pulled up. Thus, the coating layer 83C relatively thicker than in an axial central part is formed on the surface of a part of the sleeve 830 located on a lower end side at the time of immersion. Particularly, a pool part 83C1 where the thickness of the coating layer 83C is large tends to be formed on a lower end part of the sleeve 830. Further, a thin layer part 83C2 (FIG. 5) thinner than in the axial central part is formed on the surface of a part of the sleeve 830 located on an upper end side at the time of immersion.

FIG. 4A shows a film thickness distribution of the lower end side of the coating layer 83C formed on the sleeve 830 at the time of immersion. On the other hand, FIG. 4B shows a film thickness distribution of the upper end side of the coating layer 83C formed on the sleeve 830 at the time of immersion. In each of FIGS. 4A and 4B, a horizontal axis represents a distance from the end part of the sleeve 830 and a vertical axis represents a film thickness corresponding to each position in the axial direction as a difference from an average film thickness of the coating layer 83C. As shown in FIGS. 4A and 4B, a thin part (thin layer part 83C2) of the coating layer 83C on the upper end part is longer than the thick part (pool part 83C1) on the lower end part. Further, a maximum film thickness reduction (3 μm) on the upper end part of the coating layer 83C is a value approximate to a maximum film thickness increase (3.5 μm) on the lower end part.

In FIG. 5, the distribution of the coating layer 83C on the developing roller 83 is shown in an exaggerated manner. As described above, in this embodiment, the coating layer 83C is formed by the immersion method of immersing the sleeve 830 in a predetermined immersion tank such that the axial direction of the developing roller 83 extends along the vertical direction. The lower end side of the sleeve 830 of the developing roller 83 at the time of immersion is arranged in the downstream side of the development housing 80 in the first conveying direction and the upper end side of the sleeve 830 at the time of immersion is arranged in the upstream side of the development housing 80 in the first conveying direction.

With reference to FIG. 5, the first screw feeder 85 gradually supplies the developer to the magnetic roller 82 while conveying the developer in the first conveying direction (arrow D1 of FIG. 5). Further, when the toner is consumed from the developing roller 83 by the photoconductive drum 121, the developer having a low toner density is collected into the first developer storage chamber 81*a* from the developing roller 83 via the magnetic roller 82 as needed. Thus, the toner density is gradually reduced along the first conveying direction in the first developer storage chamber 81*a*. Specifically, also in the developer carried on the magnetic roller 82, the toner density on the downstream side in the first conveying direction tends to be lower than that on the upstream side in the first conveying direction. As a result, the toner density on the developing roller 83 also tends to similarly vary along the first conveying direction. According to this embodiment, the coating layer 83C of the developing roller 83 is partly thick on the downstream side in the first conveying direction (pool part 83C1). Thus, the gap between the developing roller 83 and the photoconductive drum 121 becomes narrower and development performance is enhanced on the downstream side in the first conveying direction. Thus, the toner is stably supplied from the developing roller 83 to the photoconductive drum 121 also on the downstream side in the first conveying direction having a relatively low toner density. As a result, the occurrence of an image density variation along the first conveying direction is suppressed.

Note that the developer having a relatively high toner density is carried on the upstream side of the magnetic roller 82 in the first conveying direction. Thus, the image density tends to be partly higher on the upstream side in the first conveying direction. However, in this embodiment, the coating layer 83C of the developing roller 83 is partly thin on the upstream side in the first conveying direction (thin layer part 83C2). Thus, the gap between the developing roller 83 and the photoconductive drum 121 becomes partly wider and development performance is suppressed on the upstream side in the first conveying direction. Thus, a partial increase in the image density is suppressed.

Further, in this embodiment, the touch-down development method is adopted as described above. In the developing device 122, a magnetic brush composed of the toner and the carrier is formed on the circumferential surface of the magnetic roller 82. The coating layer 83C of the developing roller 83 is abraded by a strong scraping force of the magnetic brush. The scraping force of the magnetic brush varies according to the toner density in the magnetic brush. Particularly, when the toner density is low and the surface of the carrier tends to be exposed, the scraping force of the magnetic brush increases and the abrasion of the coating layer 83C is promoted.

As described above, the second communication portion 81*d* of the developing device 122 functions as the developer retaining portion in this embodiment. The retaining portion K for the developer is formed in the downstream side of the first developer storage chamber 81*a* in the first conveying direction. Due to the influence of this retaining portion K, the amount of the developer carried on the circumferential surface of the magnetic roller 82 increases on the downstream side of the magnetic roller 82 in the first conveying direction. Particularly, a large amount of the developer is retained on the back of the developer regulation blade 84 and a pressure of the developer increases. As a result, the amount of the developer passing on a downstream side of the developer regulation blade 84 in the first conveying direction also increases as compared with an upstream side. Thus, a region where the scraping force by the magnetic brush on the magnetic roller 82 is strong (region H of FIG. 5) is generated. Such a phenomenon is notable when high-density images are successively printed in the image forming apparatus 1.

In this embodiment, as described above, the lower end side of the developing roller 83 at the time of immersion having the relatively thick coating layer 83C is arranged in the downstream (front) side of the developing device 122 in the first conveying direction. Accordingly, even if the strong scraping force of the magnetic brush is received, it is suppressed that the coating layer 83C on the downstream side in the first conveying direction becomes drastically thinner than the coating layer 83C on the upstream side in the first conveying direction or is lost. Further, the coating layer 83C is prevented from being peeled by a mechanical force by the magnetic brush.

Although the developing device 122 and the image forming apparatus 1 according to the embodiment of the present disclosure are described above, the present disclosure is not limited to these. For example, the following modifications can be adopted.

(1) Although the above embodiment is described taking the full-color image forming apparatus 1 as an example, the present disclosure is not limited to this. The image forming apparatus 1 may be a monochromatic image forming apparatus for printing a black-and-white image.

(2) Although the second communication portion 81*d* functions as the developer retaining portion in the above embodiment, the present disclosure is not limited to this. In a modification, the developer retaining portion may be a paddle member radially projecting from the shaft portion on the downstream side of the first screw feeder 85 in the first conveying direction. The retaining portion K for the developer is formed in the downstream side of the first developer storage chamber 81*a* in the first conveying direction by the integral rotation of the paddle member with the first screw feeder 85. Further, a region where the pitch of the spiral blade of the first screw feeder 85 is set partly small or a region where the spiral blade is partly arranged in an opposite direction may be the developer retaining portion. As just described, the retaining portion K for the developer can be formed in the downstream side of the first developer storage chamber 81*a* in the first conveying direction also by the shape of the spiral blade of the first screw feeder 85.

Further, the developer retaining portion may be a region where a cross-sectional area of the downstream end part of the first developer storage chamber 81*a* in the first conveying direction is set partly small in a cross-section intersecting with the direction in which the developer is conveyed. Specifically, in FIG. 2, the retaining portion K is formed in the downstream side of the first developer storage chamber 81*a* in the first conveying direction by partly arranging an inner wall defining the first developer storage chamber 81*a* at a position near the outer peripheral edge of the first screw feeder 85 in the downstream side in the first conveying direction. As just described, the retaining portion K for the developer can be formed in the downstream side of the first developer storage chamber 81*a* in the first conveying direction also by a change in the cross-sectional shape of the first developer storage chamber 81*a*.

(3) Further, although the retaining portion K is formed in the downstream side of the first developer storage chamber 81*a* to efficiently replenish the toner from the toner replenishing portion 87 in the above embodiment, the present disclosure is not limited to this. An unillustrated developer discharging portion may be arranged instead of the toner replenishing portion 87 in the downstream side of the first developer storage chamber 81*a* in the first conveying direction. When part of the developer flows into the developer discharging portion from the retaining portion K for the developer, the developer is discharged from an unillustrated discharge port after being conveyed forward by an unillustrated discharge screw. As just described, a trickle technology for discharging part of the developer from the interior of the developing device 122 may be adopted. Further, an unillustrated bearing member for rotatably supporting the first screw feeder 85 may be arranged in the downstream side of the first developer storage chamber 81*a* in the first conveying direction. In this case, the retaining portion K for the developer may be formed by forming a spiral blade having a reverse pitch on the first screw feeder 85 to prevent the entrance of the developer into the bearing member.

Figure 6:
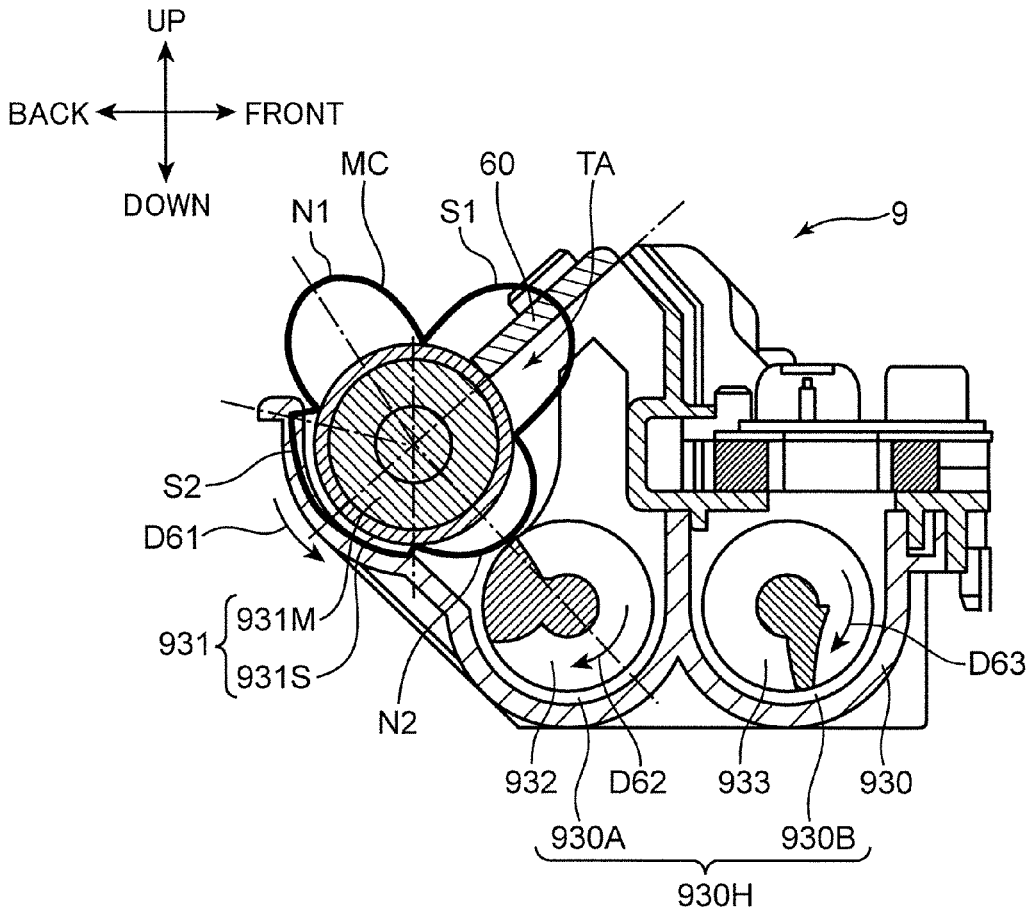
FIG. 6 is a sectional view of a developing device according to a modification of the present disclosure.

(4) Furthermore, although the above embodiment is described taking the developing device 122 adopting the touch-down development method as an example, the present disclosure is not limited to this. FIG. 6 is a sectional view of a developing device 9 according to a modification of the present disclosure. The developing device 9 includes a development housing 930 (housing), a developing roller 931 (developer carrier), a first screw feeder 932 (conveying member), a second screw feeder 933 and a regulation blade 60 (layer thickness regulating member). A magnetic one-component development method is adopted for the developing device 9.

A developer storage 930H is provided in the development housing 930. A magnetic one-component developer is stored in the developer storage 930H. Further, the developer storage 930H includes a first conveying portion 930A in which the developer is conveyed in a first conveying direction (direction perpendicular to the plane of FIG. 6, direction from left to right) from one end side toward the other end side in an axial direction of the developing roller 931, and a second conveying portion 930B which communicates with the first conveying portion 930A at opposite axial end parts and in which the developer is conveyed in a second conveying direction opposite to the first conveying direction. First and second screw feeders 932, 933 are respectively rotated in directions of arrows D62, D63 of FIG. 6 and convey the developer in the first and second conveying directions. Particularly, the first screw feeder 932 supplies the developer to the developing roller 931 while conveying the developer in the first conveying direction.

The developing roller 931 is arranged at a distance from an unillustrated image carrier, on a surface of which an electrostatic latent image is to be formed. The developing roller 931 includes a rotary sleeve 931S and a magnet 931M fixedly arranged in the sleeve 931S. In FIG. 6, a solid line MC indicates a magnetic force distribution in a normal direction to the magnet 931M. The magnet 931M includes poles S1, N1, S2 and N2. Further, the developing roller 931 is rotated in a direction of an arrow D61 of FIG. 6. The regulation blade 60 is arranged at a predetermined distance from the developing roller 931 and regulates a layer thickness of the developer supplied onto the circumferential surface of the developing roller 931 from the first screw feeder 932.

In this modification, the sleeve 931S of the developing roller 931 corresponds to a base member of the present disclosure. An unillustrated coating layer is formed on a surface of the sleeve 931S. In other words, the base member is a part of the developing roller 931 and the coating layer is formed on the circumferential surface of the developing roller 931. The coating layer is formed by the immersion method of immersing the sleeve 931S in a predetermined immersion tank so that an axial direction of the sleeve 931S extends along the vertical direction. Further, a lower end side of the sleeve 931 at the time of immersion is arranged in a downstream side of the development housing 930 in the first conveying direction and an upper end side of the sleeve 931S at the time of immersion is arranged in an upstream side of the development housing 930 in the first conveying direction.

The developing roller 931 receives the one-component developer from the first screw feeder 932 and supplies the developer to the unillustrated image carrier. When the developer on the developing roller 931 is consumed by the image carrier, the amount of the developer on a downstream side of the developing roller 931 in the first conveying direction tends to be smaller than that of the developer on an upstream side in the first conveying direction. According to the above configuration, a surface layer of the developing roller 931 is partly thick on the downstream side in the first conveying direction. Thus, a gap between the developing roller 931 and the image carrier becomes smaller and development performance is enhanced on the downstream side in the first conveying direction. Thus, the developer is stably supplied from the developing roller 931 to the image carrier also on the downstream side in the first conveying direction having a relatively small amount of the developer. As a result, the occurrence of an image density variation along the first conveying direction is suppressed.

Further, if an unillustrated developer retaining portion is arranged in a downstream side of the first conveying portion 930A in the first conveying direction as in the above embodiment, a larger amount of the developer is retained on the back (region TA of FIG. 6) of the regulation blade 60 on the downstream side in the first conveying direction than on the upstream side in the first conveying direction. Since the large amount of the developer retained in this way is strongly rubbed against the coating layer of the developing roller 931, the coating layer tends to be ground. Even in such a case, the film thickness of the coating layer on the downstream side of the developing roller 931 in the first conveying direction is initially thick in this modification. Thus, the loss of the coating layer due to abrasion can be suppressed.

EXAMPLES

Next, preferred modes of the developing roller 83 in the developing device 122 according to the embodiment are described by way of a plurality of examples.

<Evaluation 1>

This evaluation experiment was conducted under the following experimental conditions.

<Concerning Experimental Conditions>

Development method; touch-down development method

Printing speed: 25 pages/min.

Circumferential speed of photoconductive drum 121: 170 mm/sec.

Developing roller 83: alumite surface processing+nylon resin coating

Circumferential speed of the developing roller 83: ratio of 1.6 (with rotation) to that of the photoconductive drum 121

Circumferential speed of the magnetic roller 82: ratio of 1.5 (counter rotation) to that of the developing roller 83

Gap between the photoconductive drum 121 and the developing roller 83: 0.12 mm Gap between the magnetic roller 82 and the developing roller 83: 0.3 mm Surface potential of the photoconductive drum 121: +430 V (background part), +100 V (image part)

Photoconductive drum 121: OPC drum

Development biases applied to the developing roller 83: alternating-current voltage having a frequency of 3.7 kHz, duty ratio of 27%, Vpp of 1500 V, direct-current voltage of 190 V Development biases applied to the magnetic roller 82: alternating-current voltage having a frequency of 3.7 kHz, duty ratio of 73%, Vpp of 650 V, direct-current voltage of 490 V Average toner particle diameter: 6.8 μm (positive charge type)

Figure 7:
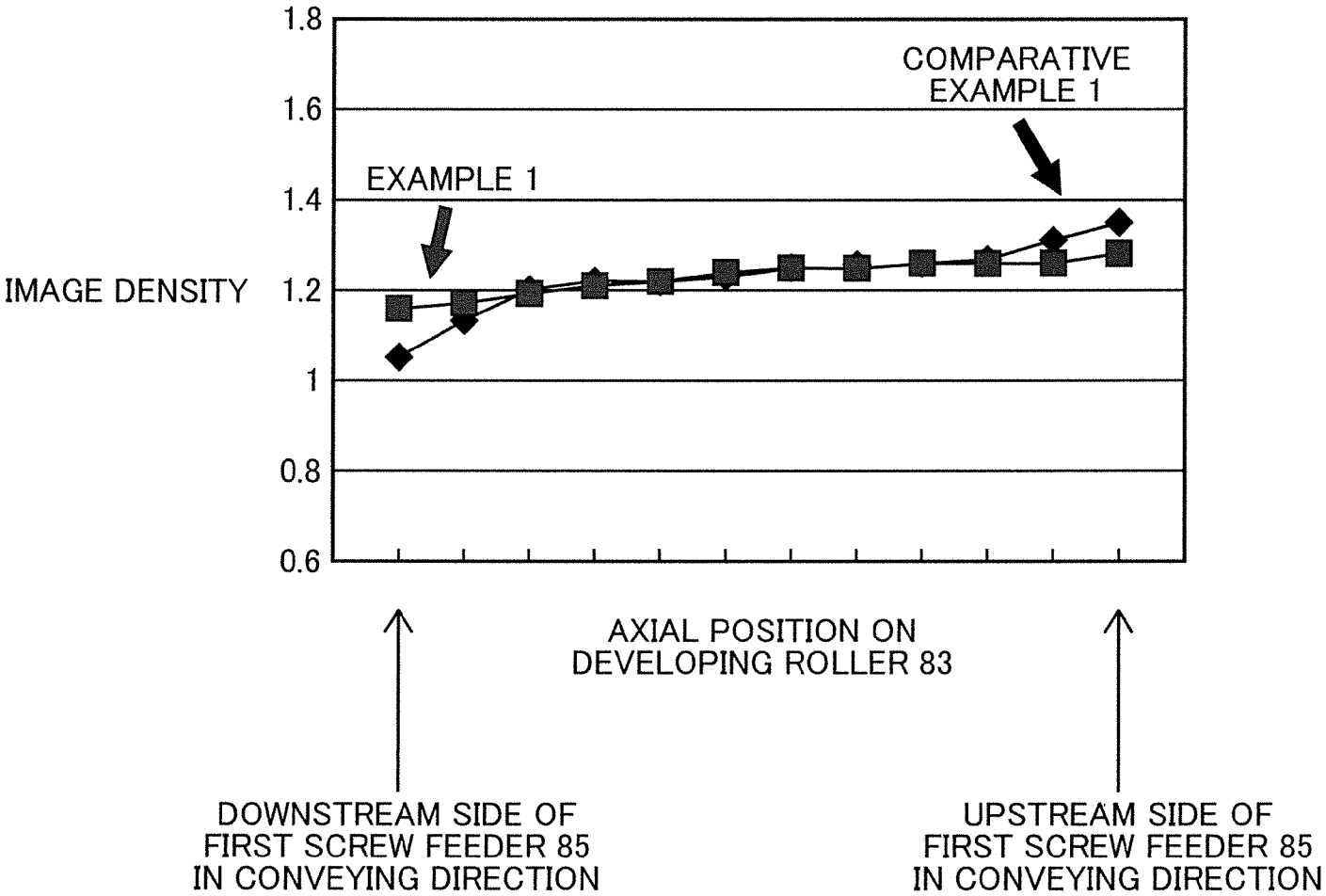
FIG. 7 is a graph showing a relationship between the arrangement of a toner carrier and an image density.

FIG. 7 is a graph showing a relationship between the arrangement of the developing roller 83 and the image density. Note that Evaluation 1 was conducted in a state where an opening cross-sectional area of the second communication portion 81*d* and a cross-sectional area of the first developer storage chamber 81*a* in the above embodiment are set equal. Specifically, the retaining portion K is not formed in the developing device 122. Further, the toner replenishing portion 87 is not arranged and the toner is replenished on the side of the second developer storage chamber 81*b*.

The lower end side of the developing roller 83 at the time of immersion is arranged in the downstream side of the development housing 80 in the first conveying direction in Example 1 of FIG. 7 and the lower end side of the developing roller 83 at the time of immersion is arranged in the upstream side of the development housing 80 in the first conveying direction in Comparative Example 1. As shown in FIG. 7, the image density is reduced in Comparative Example 1 since the amount of the toner carried on the downstream side of the developing roller 83 in the first conveying direction is small and the gap between the developing roller 83 and the photoconductive drum 121 is wide. Further, since the amount of the toner carried on the upstream side of the developing roller 83 in the first conveying direction is relatively large and the gap between the developing roller 83 and the photoconductive drum 121 is narrow, the image density is high. As a result, the image density largely varies along the axial direction of the developing roller 83 (magnetic roller 82).

On the other hand, in Example 1, the gap between the developing roller 83 and the photoconductive drum 121 is narrow although the amount of the toner carried on the downstream side of the developing roller 83 in the first conveying direction is relatively small. Thus, the image density is maintained higher than in Comparative Example 1. Further, since the gap between the developing roller 83 and the photoconductive drum 121 is wide although the amount of the toner carried on the upstream side of the developing roller 83 in the first conveying direction is large, the image density is suppressed. As a result, the image density is stably maintained along the axial direction of the developing roller 83 (magnetic roller 82).

<Evaluation 2>

This evaluation experiment was conducted under the following experimental conditions.

<Concerning Experimental Conditions>

Development method; touch-down development method

Printing speed: 30 pages/min.

Circumferential speed of photoconductive drum 121: 180 mm/sec.

Developing roller 83: alumite surface processing+nylon resin coating

Circumferential speed of the developing roller 83: ratio of 1.5 (with rotation) to that of the photoconductive drum 121

Circumferential speed of the magnetic roller 82: ratio of 1.1 (counter rotation) to that of the developing roller 83

Gap between the photoconductive drum 121 and the developing roller 83: 0.12 mm Gap between the magnetic roller 82 and the developing roller 83: 0.3 mm Surface potential of the photoconductive drum 121: +430 V (background part), +100 V (image part)

Photoconductive drum 121: OPC drum

Development biases applied to the developing roller 83: alternating-current voltage having a frequency of 3.7 kHz, duty ratio of 27%, Vpp of 1500 V, direct-current voltage of 190 V Development biases applied to the magnetic roller 82: alternating-current voltage having a frequency of 3.7 kHz, duty ratio of 73%, Vpp of 650 V, direct-current voltage of 490 V Average toner particle diameter: 6.8 μm (positive charge type)

Note that, in Evaluation 2, the retaining portion K for the developer is formed by the second communication portion 81*d* as in the above embodiment. In Evaluation 2, different developing rollers are used as Example 2 and Comparative Example 2. In the developing roller used in Comparative Example 2, the alumite processing is applied to an aluminum sleeve having a diameter of 20 mm and a spray coating layer having a thickness of about 6 μm is formed on an alumite layer. In the coating layer, 100 weight parts of titanium oxide and 5 weight parts of carbon black are added to urethane. On the other hand, in the developing roller used in Example 2, the alumite processing is applied to an aluminum sleeve having a diameter of 20 mm and a dipping film (coating layer 83C) is formed on an alumite layer by the immersion method as in the above embodiment. A film thickness on a lower end side of the dipping film at the time of immersion is 10 μm and 100 weight parts of titanium oxide is added to nylon in the dipping film. In each of Example 2 and Comparative Example 2, 100 K (100×1000) pages of images having an image density of 50% are printed. Further, in Example 2, the lower end side of the developing roller 83 at the time of immersion is arranged in the downstream side of the development housing 80 in the first conveying direction as in the above embodiment. Tables 1 show a transition of the film thickness of the coating layer of each developing roller.

TABLES 1

| | | 0k pages | 20k pages | 40k pages | 60k pages | 80k pages | 100k pages |
|---|---|---|---|---|---|---|---|
| Comparative Example 2 | | | | | | | |
| Film Thickness (μm) | Upstream Side | 6 | 5.3 | 4.8 | 4.2 | 3.7 | 3 |
| | Downstream Side | 6 | 4 | 2 | 1 | 0 | 0 |
| Example 2 | | | | | | | |
| Film Thickness (μm) | Upstream Side | 4 | 3.8 | 3.6 | 3.4 | 3.2 | 3 |
| | Downstream Side | 10 | 9 | 8 | 7 | 6 | 5 |

As shown in Tables 1, in Comparative Example 2, a downstream side of the coating layer formed by spray coating in the first conveying direction became drastically thin and the alumite layer of the developing roller was, as a result, exposed after printing 80 k pages. This is because the amount of the developer on the magnetic roller 82 is increased by the retaining portion K and the coating layer of the developing roller tends to be ground. If the alumite layer is exposed in this way, an adhesive force between the toner and the developing roller increases and a density reduction is brought about by the deterioration of development performance.

On the other hand, in Example 2, the pool part 83C1 of the developing roller 83 is arranged in the downstream side of the development housing 80 in the first conveying direction. Thus, even if the coating layer was ground by the developer on the magnetic roller 82, the thickness thereof did not fall below 3 μm after the printing of 100 k pages was finished and stable images were maintained.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device comprising:

a housing;

a cylindrical developer carrier supported in the housing rotatably about an axis, the developer carrier having a circumferential surface configured to carry a developer that comprises a toner and a carrier;

a developer storage arranged in the housing to face the developer carrier and including a first conveying portion in which the developer is conveyed in a first conveying direction from one end side toward the other end side in an axial direction of the developer carrier and a second conveying portion that communicates with the first conveying portion on opposite end parts in the axial direction and in which the developer is conveyed in a second conveying direction opposite to the first conveying direction;

a conveying member rotatably arranged in the first conveying portion and configured to convey the developer in the first conveying direction and to supply the developer to the developer carrier;

a layer thickness regulating member arranged at a predetermined distance from the developer carrier and configured to regulate a layer thickness of the developer supplied onto the circumferential surface of the developer carrier from the conveying member;

a cylindrical toner carrier arranged at distances from the developer carrier and from an image carrier that has a surface on which an electrostatic latent image is to be formed, the toner carrier being supported in the housing rotatably about an axis, the toner carrier having a cylindrical base member with a surface layer arranged to face the circumferential surface of the developer carrier, the surface layer being formed by an immersion method of immersing the base member in a predetermined immersion tank so that an axial direction of the base member extends along a vertical direction, and a lower end side of the base member at the time of the immersion is arranged in a downstream side of the housing in the first conveying direction and an upper end side of the base member at the time of the immersion is arranged in an upstream side of the housing in the first conveying direction, the surface layer being disposed and configured to receive on a circumferential surface thereof the toner from the developer carrier and to carry the toner; and a developer retaining portion arranged in a downstream side of the first conveying portion in the first conveying direction and allowing communication between the downstream side of the first conveying portion in the first conveying direction and an upstream side of the second conveying portion in the second conveying direction, a cross-sectional area of the developer retaining portion is set smaller than that of the first conveying portion in a cross-section intersecting with a direction in which the developer is conveyed so that the developer retaining portion is configured to partially retain the developer.

2. A developing device according to claim 1, wherein:

the conveying member includes a shaft portion and a spiral blade arranged around the shaft portion; and the developer retaining portion is a paddle member radially projecting from the shaft portion in a downstream side of the conveying member in the first conveying direction.

3. A developing device according to claim 1, wherein:

the conveying member includes a shaft portion and a spiral blade arranged around the shaft portion; and the developer retaining portion is a region where a pitch of the spiral blade is set partly small in a downstream side of the conveying member in the first conveying direction.

4. A developing device according to claim 1, wherein:

the conveying member includes a shaft portion and a spiral blade arranged around the shaft portion; and the developer retaining portion is a region where the spiral blade is partly wound in an opposite direction in a downstream side of the conveying member in the first conveying direction.

5. A developing device according to claim 1, further comprising:

a developer replenishing portion communicating with the downstream side of the first conveying portion and to be replenished with the developer.

6. An image forming apparatus, comprising:

a developing device according to claim 1; and an image carrier on a surface of which an electrostatic latent image is to be formed and to which the developer is supplied from the developing device.

7. A developing device, comprising:

a housing;

a cylindrical developer carrier supported in the housing rotatably about an axis, the developer carrier having a circumferential surface configured to carry a developer that comprises a toner and a carrier;

a developer storage arranged in the housing to face the developer carrier and including a first conveying portion in which the developer is conveyed in a first conveying direction from one end side toward the other end side in an axial direction of the developer carrier and a second conveying portion that communicates with the first conveying portion on opposite end parts in the axial direction and in which the developer is conveyed in a second conveying direction opposite to the first conveying direction;

a conveying member rotatably arranged in the first conveying portion and configured to convey the developer in the first conveying direction and to supply the developer to the developer carrier;

a layer thickness regulating member arranged at a predetermined distance from the developer carrier and configured to regulate a layer thickness of the developer supplied onto the circumferential surface of the developer carrier from the conveying member;

a cylindrical toner carrier arranged at distances from the developer carrier and from an image carrier that has a surface on which an electrostatic latent image is to be formed, the toner carrier being supported in the housing rotatably about an axis, the toner carrier having a cylindrical base member with a surface layer arranged to face the circumferential surface of the developer carrier, the surface layer being formed by an immersion method of immersing the base member in a predetermined immersion tank so that an axial direction of the base member extends along a vertical direction, and a lower end side of the base member at the time of the immersion is arranged in a downstream side of the housing in the first conveying direction and an upper end side of the base member at the time of the immersion is arranged in an upstream side of the housing in the first conveying direction, the surface layer being disposed and configured to receive on a circumferential surface thereof the toner from the developer carrier and to carry the toner; and a developer retaining portion arranged in a downstream side of the first conveying portion in the first conveying direction, the developer retaining portion is a region where a cross-sectional area of the downstream side of the first conveying portion in the first conveying direction is set partly small in a cross-section intersecting with a direction in which the developer is conveyed so that the developer retaining portion is configured to partially retain the developer.

8. An image forming apparatus, comprising:

a developing device according to claim 7; and an image carrier on a surface of which an electrostatic latent image is to be formed and to which the developer is supplied from the developing device.

9. A developing device comprising:

a housing;

a cylindrical developer carrier supported in the housing rotatably about an axis, the developer carrier being arranged at a distance from an image carrier on a surface of which an electrostatic latent image is formed, the developer carrier having a cylindrical base member with a surface layer on the base member, the surface layer being configured to carry a one-component developer on a circumferential surface thereof, the surface layer being formed by an immersion method of immersing the base member in a predetermined immersion tank so that an axial direction of the base member extends along a vertical direction, and a lower end side of the base member at the time of the immersion is arranged in a downstream side of the housing in the first conveying direction and an upper end side of the base member at the time of the immersion is arranged in an upstream side of the housing in the first conveying direction, the surface layer being disposed and configured to receive the toner on a circumferential surface thereof from the developer carrier and to carry the toner;

a developer storage arranged in the housing to face the developer carrier and including a first conveying portion in which the developer is conveyed in a first conveying direction from one end side toward the other end side in an axial direction of the developer carrier and a second conveying portion that communicates with the first conveying portion on opposite end parts in the axial direction and in which the developer is conveyed in a second conveying direction opposite to the first conveying direction;

a conveying member rotatably arranged in the first conveying portion and configured to convey the developer in the first conveying direction and to supply the developer to the developer carrier;

a layer thickness regulating member arranged at a predetermined distance from the developer carrier and configured to regulate a layer thickness of the developer supplied onto the circumferential surface of the developer carrier from the conveying member; and a developer retaining portion arranged in a downstream side of the first conveying portion in the first conveying direction and allowing communication between the downstream side of the first conveying portion in the first conveying direction and an upstream side of the second conveying portion in the second conveying direction, the developer retaining portion having a cross-sectional area smaller than that of the first conveying portion in a cross-section intersecting with a direction in which the developer is conveyed so that the developer retaining portion is configured to partially retain the developer.

10. A developing device according to claim 9, wherein:

the conveying member includes a shaft portion and a spiral blade arranged around the shaft portion; and the developer retaining portion is a paddle member radially projecting from the shaft portion in the downstream side of the conveying member in the first conveying direction.

11. A developing device according to claim 9, wherein:

the conveying member includes a shaft portion and a spiral blade arranged around the shaft portion; and the developer retaining portion is a region where a pitch of the spiral blade is set partly small in the downstream side of the conveying member in the first conveying direction.

12. A developing device according to claim 9, wherein:

the conveying member includes a shaft portion and a spiral blade arranged around the shaft portion; and the developer retaining portion is a region where the spiral blade is partly wound in an opposite direction in the downstream side of the conveying member in the first conveying direction.

13. A developing device according to claim 9, further comprising:

a developer replenishing portion communicating with the downstream side of the first conveying portion and to be replenished with the developer.

14. An image forming apparatus, comprising:

a developing device according to claim 9; and an image carrier on a surface of which an electrostatic latent image is to be formed and to which the developer is supplied from the developing device.

15. A developing device, comprising:

a housing;

a cylindrical developer carrier supported in the housing rotatably about an axis, the developer carrier being arranged at a distance from an image carrier on a surface of which an electrostatic latent image is formed, the developer carrier having a cylindrical base member with a surface layer on the base member, the surface layer being configured to carry a one-component developer on a circumferential surface thereof, the surface layer being formed by an immersion method of immersing the base member in a predetermined immersion tank so that an axial direction of the base member extends along a vertical direction, and a lower end side of the base member at the time of the immersion is arranged in a downstream side of the housing in the first conveying direction and an upper end side of the base member at the time of the immersion is arranged in an upstream side of the housing in the first conveying direction, the surface layer being disposed and configured to receive the toner on a circumferential surface thereof from the developer carrier and to carry the toner;

a developer storage arranged in the housing to face the developer carrier and including a first conveying portion in which the developer is conveyed in a first conveying direction from one end side toward the other end side in an axial direction of the developer carrier and a second conveying portion that communicates with the first conveying portion on opposite end parts in the axial direction and in which the developer is conveyed in a second conveying direction opposite to the first conveying direction;

a conveying member rotatably arranged in the first conveying portion and configured to convey the developer in the first conveying direction and to supply the developer to the developer carrier;

a layer thickness regulating member arranged at a predetermined distance from the developer carrier and configured to regulate a layer thickness of the developer supplied onto the circumferential surface of the developer carrier from the conveying member; and a developer retaining portion arranged in a downstream side of the first conveying portion in the first conveying direction, the developer retaining portion is a region where a cross-sectional area of the downstream side of the first conveying portion in the first conveying direction is set partly small in a cross-section intersecting with a direction in which the developer is conveyed so that the developer retaining portion is configured to partially retain the developer.

16. An image forming apparatus, comprising:

a developing device according to claim 15; and an image carrier on a surface of which an electrostatic latent image is to be formed and to which the developer is supplied from the developing device.

* * * * *